US008584896B2

(12) United States Patent
Long et al.

(10) Patent No.: US 8,584,896 B2
(45) Date of Patent: Nov. 19, 2013

(54) FOLDED CLIP AND DISPENSER

(75) Inventors: Leslie Thomas Long, Appleton, WI (US); Emory Emil Luebke, Greenville, WI (US); Michelle Lynn Seabaugh, Grand Chute, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 3069 days.

(21) Appl. No.: 10/955,435

(22) Filed: Sep. 30, 2004

(65) Prior Publication Data

US 2006/0102644 A1 May 18, 2006

(51) Int. Cl.
*B65H 1/00* (2006.01)

(52) U.S. Cl.
USPC ..... 221/63; 221/45; 221/46; 221/48; 221/49

(58) Field of Classification Search
USPC ..... 221/63, 45, 46, 48, 49
See application file for complete search history.

(56) References Cited

U.S. PATENT DOCUMENTS 2,611,482 A 9/1952 Nelson
3,679,094 A * 7/1972 Nissen et al. ..... 221/50
3,700,138 A * 10/1972 Nelson ..... 221/51
3,881,632 A * 5/1975 Early et al. ..... 221/50
5,215,757 A 6/1993 El-Nokaly
5,516,000 A 5/1996 Freiburger et al.
5,599,555 A 2/1997 El-Nokaly
5,644,897 A 7/1997 Young et al.
5,918,735 A 7/1999 Bando et al.
5,980,931 A 11/1999 Fowler et al.
6,121,165 A 9/2000 Mackey et al.
6,349,525 B1 * 2/2002 Veith ..... 53/429
6,499,175 B1 * 12/2002 Osiecki et al. ..... 15/159.1
6,732,492 B2 5/2004 Osborne et al.
7,028,860 B2 * 4/2006 Behnke et al. ..... 221/49
2001/0039785 A1 11/2001 Greenwell et al.
2004/0016211 A1 1/2004 Osborne et al.

FOREIGN PATENT DOCUMENTS

EP 0 644 130 A1 3/1995

* cited by examiner

*Primary Examiner* — Stefanos Karmis
*Assistant Examiner* — Michael E Butler
(74) *Attorney, Agent, or Firm* — Michael J. Sullivan

(57) ABSTRACT

By either rotating a folded clip within a dispenser, or by folding the clip into a J-shape instead of a U-shape and then placing the clip into a dispenser, more sheets can be placed into the dispenser without causing an increase in dispensing problems. Alternatively, fewer dispensing problems result if the same number of sheets is placed into the dispenser. In one embodiment, the dispenser was an upright facial tissue carton and the clip was an interfolded stack of facial tissues.

4 Claims, 6 Drawing Sheets

FOLDED CLIP AND DISPENSER

BACKGROUND

Sheet materials, such as tissue paper, are often interfolded into stacks or clips and then placed into a dispenser such that upon removal of one sheet, a subsequent sheet is partially dispensed having an exposed portion that extends from the dispenser's opening. This method of "pop-up" sheet dispensing is convenient for many applications, since the next sheet is readily presented for quick access. Frequently, the sheet materials are packaged in an "upright" or "boutique" type dispenser since this dispenser has a smaller footprint than standard sized dispensers.

To dispense the sheet material from an upright dispenser, the sheet material is typically interfolded into a clip of tissues and then the clip is folded symmetrically in half about a transverse central axis of the clip to form a U-shaped clip that is loaded into the dispenser. The U-shaped clip is loaded into the dispenser such that the radius of the U is directly beneath the dispensing window located in the dispenser's top.

Loading an upright dispenser with the clip in this manner can cause the first few sheets to be difficult to remove, especially as the number of sheets in the dispenser is increased or as the bulk/thickness of the sheet material is increased. The sheet material can be pushed tightly against the opposing vertical walls of the upright dispenser after the folded clip is placed in the dispenser since the clip tends to spring back into an uncompressed state over time. This can lead to tearing of the sheet material as the initial sheets are dispensed.

Increasing the overall size of the dispenser or reducing the number of sheets in the clip are both viewed as unacceptable solutions. The current size of the upright dispenser has become standardized, and many people have decorative covers designed to fit over the size of an upright dispenser. Reducing the number of sheets will impact the perceived value by a purchaser who expects to receive a significant number of sheets such that the product will last a long time in use. Thus, what is needed is a dispenser in combination with a folded clip that can dispense more sheets from the same size dispenser while still achieving acceptable dispensing or a dispenser that reduces the initial dispensing problems with current upright sheet dispensers.

SUMMARY

The inventors have discovered that by either rotating the folded clip within the dispenser, or by folding the clip into a J-shape instead of a U-shape, more sheets can be placed into a dispenser without causing an increase in dispensing problems. Alternatively, fewer dispensing problems result if the same number of sheets is placed into the dispenser.

Hence in one aspect, the invention resides in a product including: an upright dispenser having a top, a bottom, a sidewall, and a dispensing opening; a folded clip of sheet material located within the dispenser having a first end, a second end, a folded end, and a longitudinal fold axis; and wherein the folded clip is oriented within the dispenser such that the longitudinal fold axis intersects with the dispenser's sidewall, and the sheet material is dispensed from either the folded end of the clip or from the first and second ends of the clip.

In another aspect, the invention resides in a folded clip of sheet material wherein the clip is folded about a transverse fold axis having an offset dimension X from a transverse central axis of between about 0.1 mm to about 70.

In another aspect, the invention resides in a folded clip of sheet material disposed in an upright dispenser, and the upright dispenser having a Fill Ratio between about 75 percent to about 100 percent.

BRIEF DESCRIPTION OF THE DRAWINGS

The above aspects and other features, aspects, and advantages of the present invention will become better understood with regard to the following description, appended claims, and accompanying drawings in which:

DEFINITIONS

Figure 1:
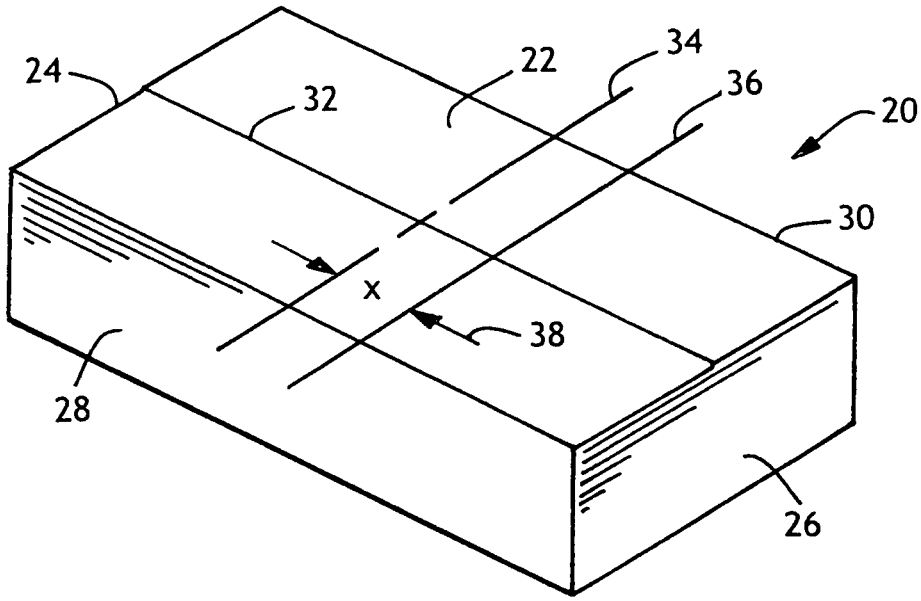
FIG. 1 illustrates a clip of sheet material.

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; shop towels; and metal substrates such as aluminum foil. Furthermore, laminated or plied together substrates of two or more layers of any of the preceding substrates are also suitable.

As used herein, "wet sheet material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931, entitled Cleansing Products Having A Substantially Dry Substrate and issued to Fowler et al. on Nov. 9, 1999. Other suitable wet sheet materials can have encapsulated ingredients such that the capsules rupture during dispensing or use. Examples of encapsulated materials include those disclosed in U.S. Pat. No. 5,215,757, entitled Encapsulated Materials and issued to El-Nokaly on Jun. 1, 1993, and U.S. Pat. No. 5,599,555, entitled Encapsulated Cosmetic Compositions and issued to El-Nokaly on Feb. 4, 1997. Other suitable wet sheet materials include dry substrates that deliver liquid when subjected to in-use shear and compressive forces. Such substrates are disclosed in U.S. Pat. No. 6,121,165, entitled Wet-Like Cleaning Articles and issued to Mackay et al. Sep. 19, 2000.

As used herein, an "upright dispenser" is a dispenser that dispenses sheet materials that have been assembled into a clip and the clip is folded about a transverse axis prior to inserting the clip into the dispenser. In one embodiment, the upright dispenser comprised a tissue carton made from board stock having an overall height of approximately 127 mm and a footprint or bottom of approximately 110 mm by 110 mm that formed a parallelepiped, having a generally cubical shape that housed a plurality of facial tissue sheets.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Referring now to FIG. 1, a clip 20 of sheet material 22 is illustrated. The clip 20 comprises a specific number of individual sheets. If desired, the sheets can be folded prior to stacking them to form the clip. Alternatively, individual non-folded sheets could be stacked to form the clip. The sheets within the clip can be either interfolded for pop-up dispensing, joined together by weakened lines such as perforations for pop-up dispensing, or individually folded for reach-in dispensing. In various embodiments of the invention, the clip can contain between about 10 to about 500 sheets, or between about 50 to about 300 sheets, or between about 60 to about 150 sheets. In one embodiment, the clip was a stack of interfolded facial tissue sheets containing between about 60 to about 135 interfolded facial tissue sheets.

The clip 20 has a first 24 and a second 26 opposing end, and a first 28 and a second 30 opposing side. Typically, a free end 32 of the sheet material is positioned near the center of the clip and aligned with the longitudinal central axis so that it can be easily accessed after the clip is placed into a dispenser. The clip also has a transverse central axis 34 and a transverse fold axis 36. Unlike prior folded clips, the transverse fold axis 36 is located an offset distance X (reference numeral 38) to either side of the transverse central axis 34.

Figure 2:
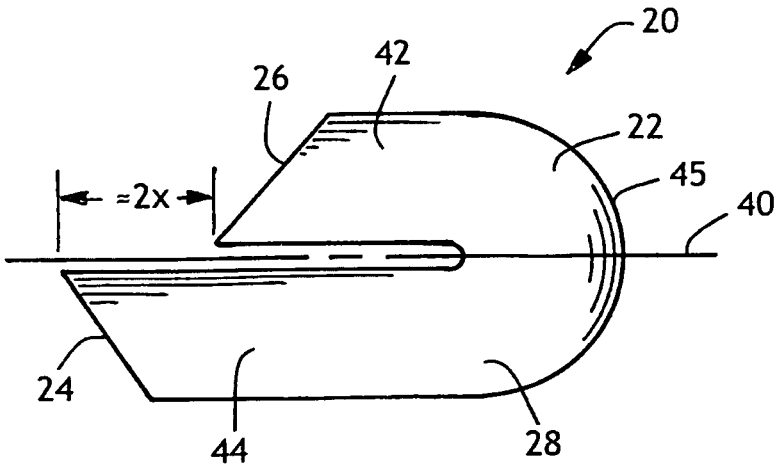
FIG. 2 illustrates the clip of FIG. 1 folded along a transverse fold line illustrating one embodiment of the invention.
Figure 5:
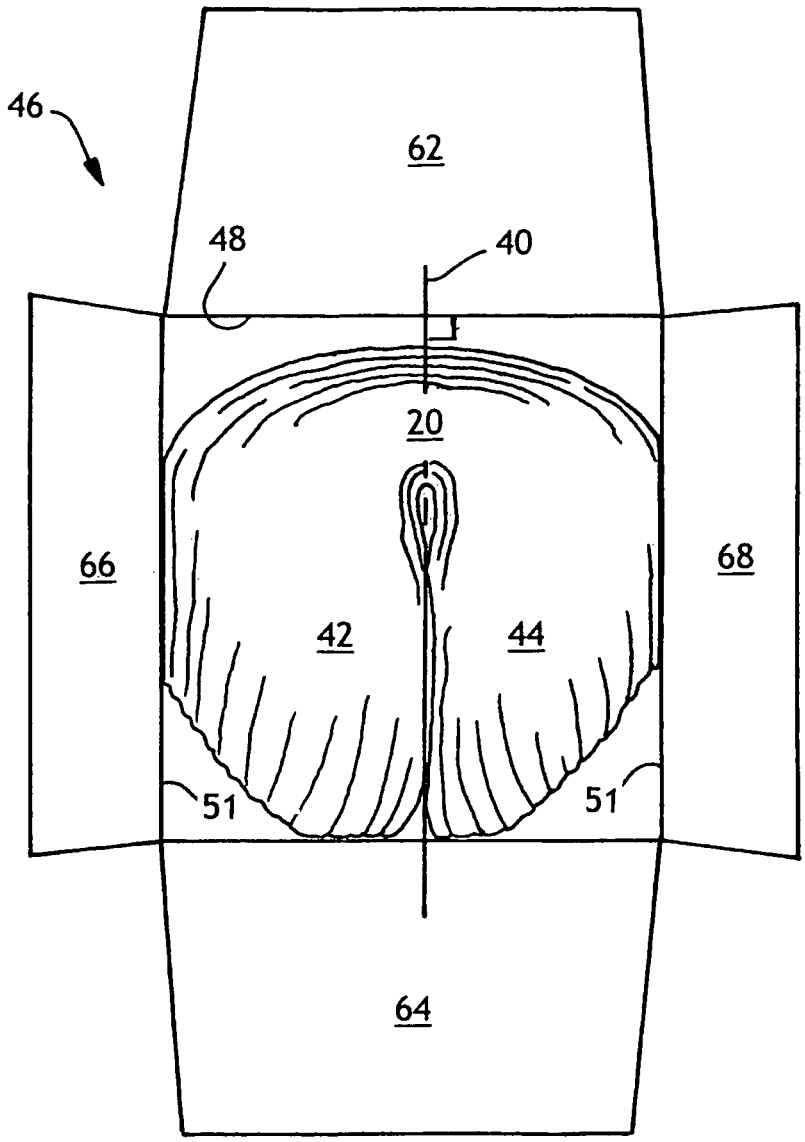
FIG. 5 (PRIOR ART)
FIG. 5 illustrates a prior art dispenser with one side open to show the position of the U-shaped clip within the dispenser.

When folded, the clip 20 assumes a J-shape as shown in FIG. 2 instead of the symmetrical U-shape of prior folded clips (FIG. 5). Once folded, the clip 20 has a longitudinal fold axis 40 where the first clip portion 42, or upper portion of the clip, touches or lies adjacent to the second clip portion 44, or lower portion of the clip. The clip also has a folded end 45 located opposite the first and second ends (24, 26). Once folded, the second end 26 is offset a distance of approximately 2X relative to the first end 24. Additionally, the first and second ends (24, 26) become angled or slanted relative to the longitudinal fold axis 40, since the radius of curvature for each sheet increases as you move outward from the inside to the outside of the folded clip. In various embodiments of the invention, the offset distance X can be between about 0.1 mm to about 70 mm, or between about 2 mm to about 40 mm, or between about 5 mm to about 20 mm, or between about 5 mm to about 15 mm. In one embodiment, the offset distance X was approximately 9 mm when a facial tissue clip having an overall length of approximately 212 mm was folded into a J-shaped clip. Selection of the offset distance X will depend, to some extent, on the size of the dispenser the clip is placed into and/or the length and width of the clip prior to folding the clip into a J-shape.

Figure 3:
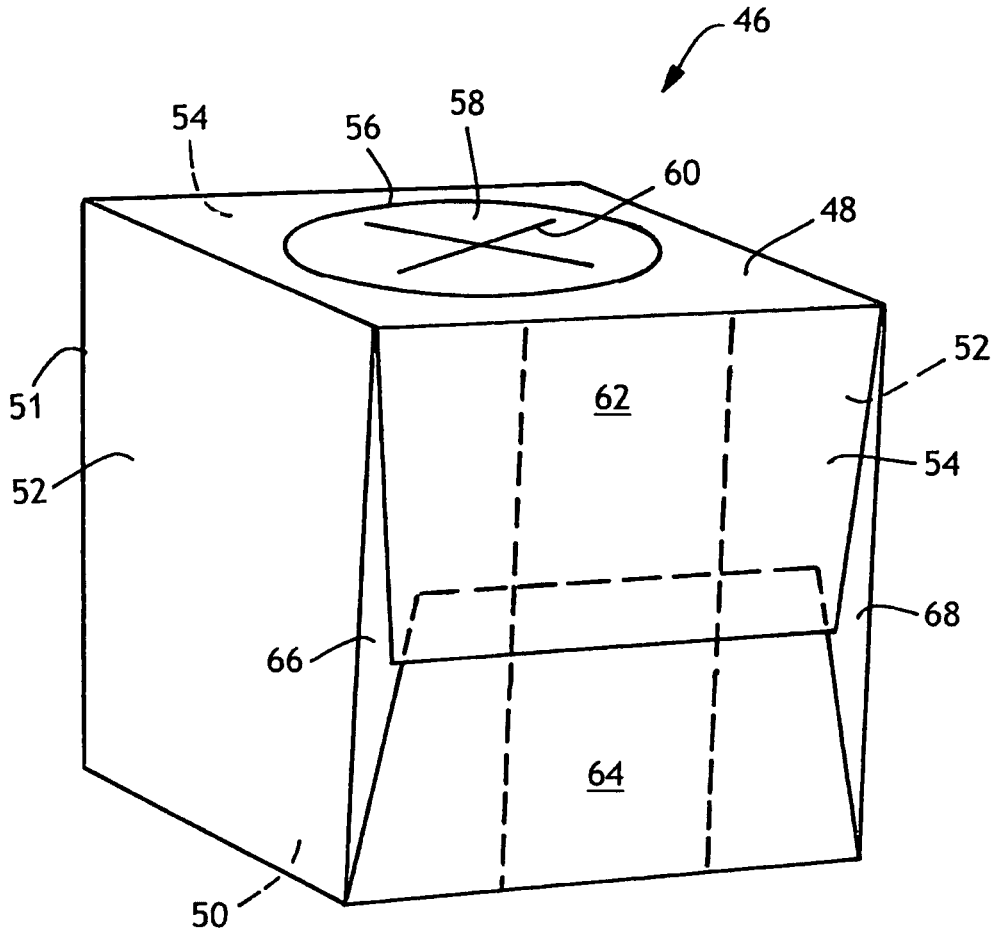
FIG. 3 illustrates an upright dispenser.

Referring now to FIG. 3, a perspective view of one embodiment of a dispenser 46 containing the J-shaped clip of FIG. 2 is illustrated. The dispenser includes a top 48, a bottom 50, and a sidewall 51 formed from two pairs of opposing sidewalls 52 and 54 that intersect at approximately 90 degree angles. The top 48 includes a dispensing opening 56 that can be any size or shape such as square, rectangular, circular, triangular or oval. In an alternative embodiment, the dispensing opening 56 has a portion that resides in the top and another portion that resides in the sidewall 51 similar to the oval dispensing opening shown in FIG. 7.

The dispensing opening can include a dispensing window 58 made from a suitable material such as a film, nonwoven, or paper material that can retain a partially dispensed sheet within the dispensing opening for pop-up dispensing. The dispensing window 58 can include a dispensing orifice 60 that can be a slit; a curvilinear line; a geometric shape such as an oval, a circle, or a triangle; or an X-shaped, +-shaped or H-shaped slit or slot. Alternatively, the dispensing window can be eliminated and fingers or tabs projecting into the dispensing opening 56 can be used to retain the partially dispensed sheet.

For ease of loading the clip into the dispenser using automated packaging equipment, generally the first pair of opposing sidewalls 52 are unitary and the second pair of opposing sidewalls 54 are formed from a plurality of flaps. The second pair of opposing sidewalls 54 can include an upper major flap 62, a lower major flap 64, a left minor flap 66, and a right minor flap 68. The flaps can be folded such that they overlap and then are glued together to form the second pair of opposing sidewalls 54 after filling the dispenser 46 with the clip 20.

Figure 4:
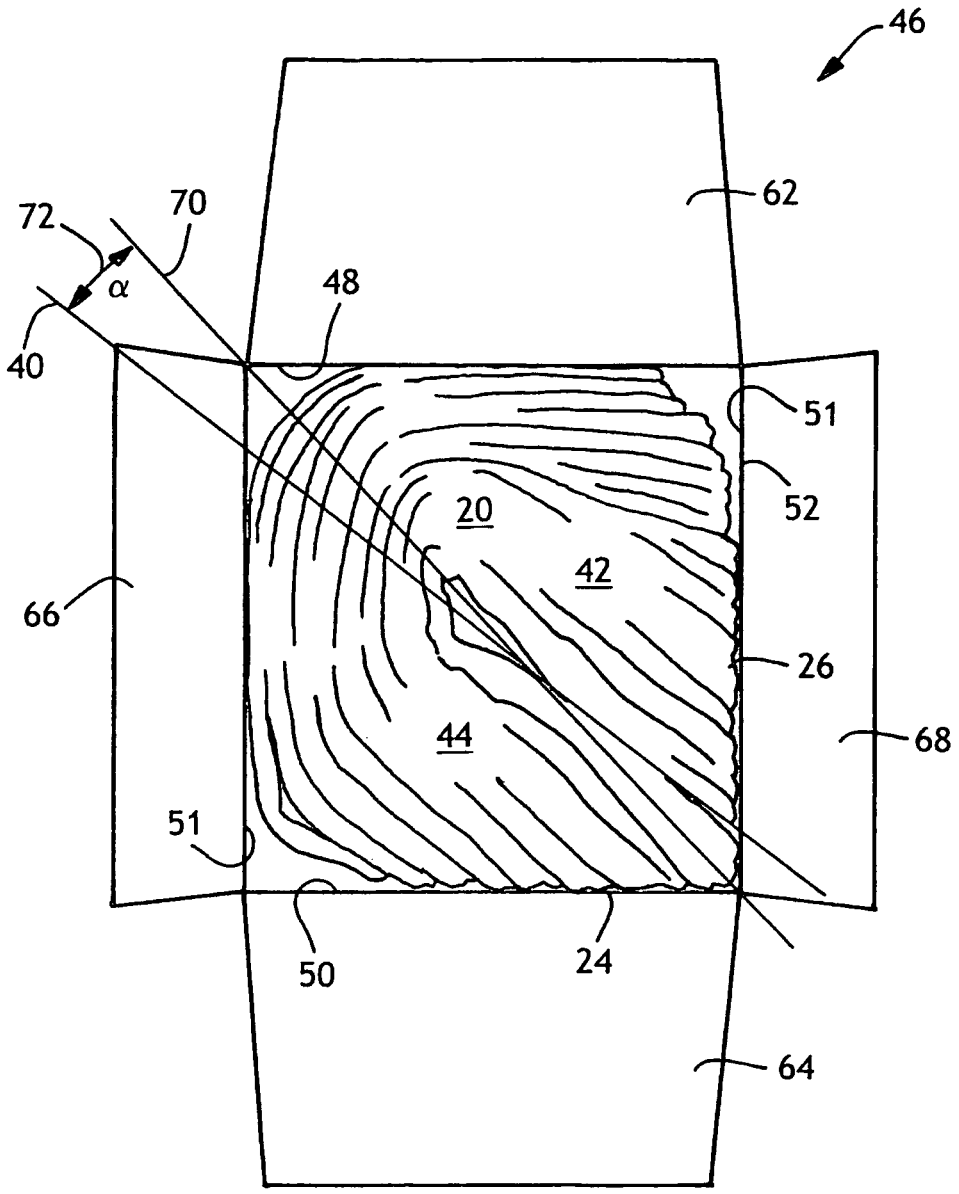
FIG. 4 illustrates the dispenser of FIG. 3 with the one side open to show the position of the clip of FIG. 2 within the dispenser.

Referring now to FIG. 4, the position of the clip 20 within the dispenser 46 can be observed with the flaps opened on one side of the dispenser. The clip 20 is tilted within the dispenser such that the longitudinal fold axis 40 is not perpendicular to the top 48 as seen in the prior art dispenser illustrated in FIG. 5. Tilting of the clip 20 results in an improved utilization of the available space within the dispenser by either allowing for more sheets to be contained by the dispenser with no increase in dispensing problems or by reducing the occurrence of the dispensing problems encountered for the same number of sheets.

The inventors have determined that by loading a J-shaped or U-shaped clip into the dispenser as illustrated, the dispenser's individual sheet capacity for the same type of sheet material can be increased by up to about 30 percent without an increase in dispensing problems. It is believed that the increased sheet capacity results from not having the first and second clip portions (42 and 44) on opposite sides of the longitudinal fold axis 40 pushing against the vertical sidewall as shown in the prior art dispenser of FIG. 5. This clip orientation creates substantial frictional forces as the compressed clip pushes against the sidewall leading to dispensing failures when trying to remove the initial sheets. Instead, as shown in FIG. 4, the first clip portion 42 is free to move up towards the top 48 while the second clip portion lies at an angle relative to the bottom 50. This reduces the pressure between the clip 20 and the interior portions of the dispenser. As a result, in one embodiment, the sheet material at the second end 26 is oriented approximately perpendicular to one of the first pair of opposing walls 52, while the upper sheets of the first clip portion 42 are substantially parallel to the top 48. The clip 20 takes on a more square overall shape when positioned into the dispenser, thereby utilizing more of the carton's interior space and significantly reducing the force of the clip against the interior of the dispenser. Notably, the upper clip portion 42 is not compressed against the interior sidewall of the dispenser and the individual sheets within the clip are under much less internal pressure as a result.

The above benefits can be achieved by orientating the longitudinal fold axis 40 such that the axis 40 is aligned with or rotated past a diagonal dispenser axis 70 that intersects two opposing corners of the dispenser 20. The diagonal dispenser axis 70 is drawn between two opposing corners where the top 48 joins the sidewall 51 and where the bottom 50 joins the sidewall 51. The diagonal dispenser axis 70 should be drawn between the pair of opposing corners that minimizes an angle α (72) between the longitudinal fold axis 40 and the diagonal dispenser axis 70 as illustrated. In the illustrated embodiment, the longitudinal fold axis 40 is oriented to intersect with the dispenser's sidewall 51 as opposed to the top 48, as done in the prior art dispenser shown in FIG. 5. If the longitudinal fold axis 40 is aligned with the diagonal dispenser axis 70, it still intersects with the sidewall 51 at the corner where the sidewall 51 meets the top 48. In various embodiments of the invention, the angle α (72) between the diagonal dispenser axis 70 and longitudinal fold axis 40 can be between about 0 to about 45 degrees, or between about 0 degrees to about 30 degrees, or between about 1 degree to about 20 degrees, or between about 1 degree to about 10 degrees.

Figure 6:
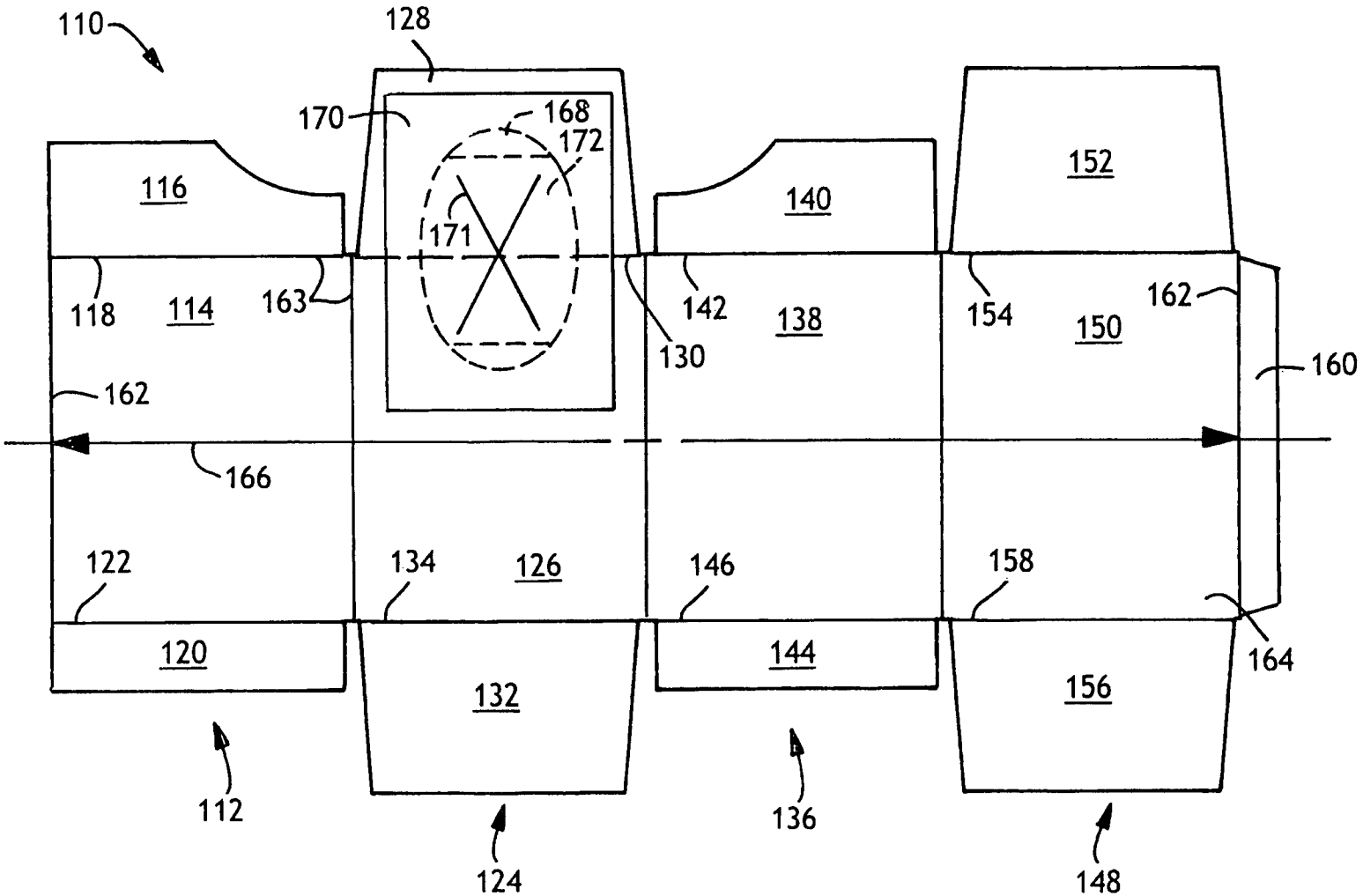
FIG. 6 illustrates a carton blank for an upright dispenser.
Figure 7:
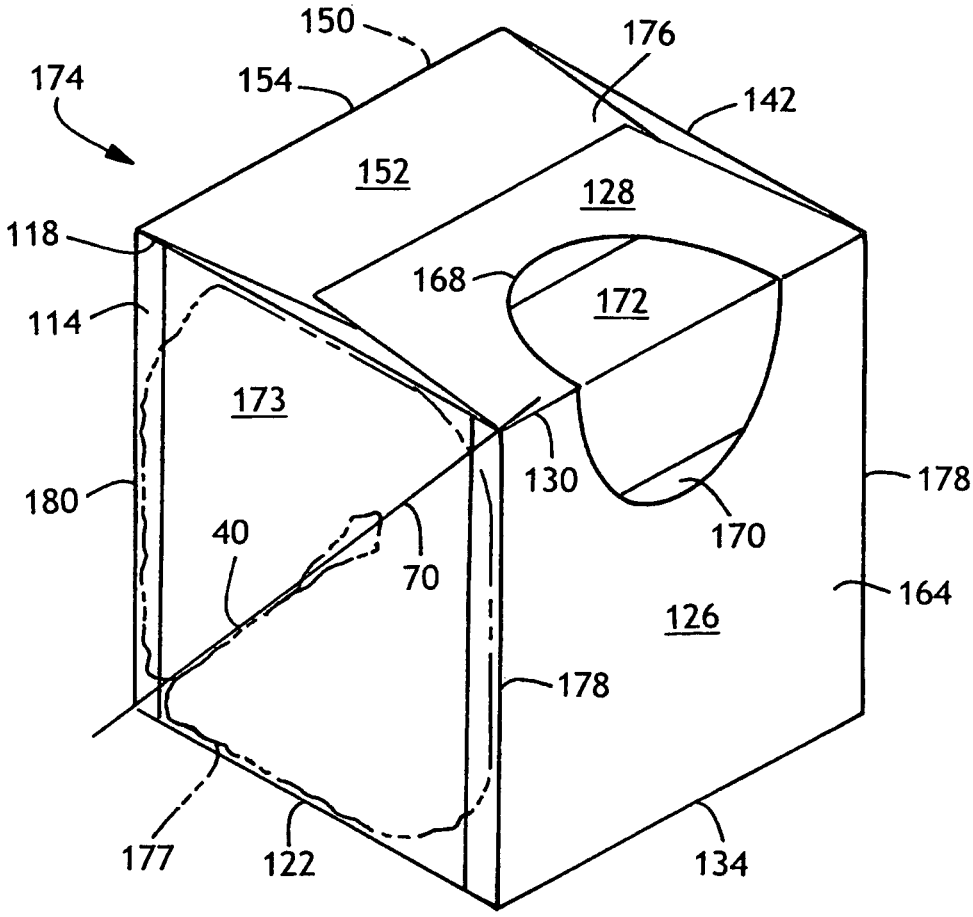
FIG. 7 illustrates the clip of FIG. 2 within the dispenser of FIG. 6.

Referring now to FIGS. 6 and 7, another upright dispenser for use with the invention is illustrated as a blank (FIG. 6) which can be folded into a dispenser. FIG. 7 shows the orientation of the longitudinal fold axis 40 for the clip 20 contained within the dispenser 174. As seen, the longitudinal fold axis 40 is aligned with the diagonal dispenser axis 70 such that the angle α (72) is approximately 0 degrees. In this manner, the longitudinal fold axis 40 points at the oval dispensing opening 168 that spans a portion of the dispenser's top 176 and a portion of the dispenser's sidewall 164. Because the dispensing opening has been moved to correspond better with the tilted or rotated clip's position, further improvements in dispensing of the sheet material from the clip are possible. This allows for additional sheets to be contained by the upright dispenser without an increase in dispensing failures or for a reduction in dispensing related failures when using the same number of sheets. The improvement results for both a J-shaped clip folded about an offset fold axis and for a U-shaped clip folded about a transverse central axis.

Additionally, by moving the dispensing opening to the location shown in FIG. 7 from its location shown in FIG. 3, it is possible to offer a choice in the manner in which the sheet material is withdrawn from the folded clip. In particular, the clip 20 can be disposed within the dispenser 174 such that the folded end 45 is placed adjacent the dispensing opening 168, or the clip can be reversed such that the first and second ends (24 and 26) are placed adjacent the dispensing opening 168. This allows for a choice of dispensing the sheet material from either the outside of the folded clip or from the middle of the folded clip. Depending on the type of sheet material being dispensed and the number of sheets within the clip, reversing the orientation of the clip with respect to the dispensing window can provide an improved dispensing function. As mentioned, the dispenser opening of FIG. 3 can be relocated in a manner similar to the dispenser of FIG. 7.

A top plan view of a blank, generally indicated by the numeral 110 for an upright dispenser is shown in FIG. 6. The inside surface of the blank or the resulting dispenser's interior surface is illustrated. In one embodiment, the dispenser was a facial tissue carton suitable for housing a plurality of facial tissue sheets. The blank and the resulting dispenser can be used to house other suitable sheet materials.

The blank 110 includes a first section 112 having a first section decorative panel 114, a first section top flap 116 disposed at a first end 118 of the first section decorative panel and a first section bottom flap 120 disposed at a second end 122 of the first section decorative panel. The blank 110 further includes a second section 124 connected to first section 112, the second section having a second section decorative panel 126, a second section top flap 128 disposed at a first end 130 of the second section decorative panel and a second section bottom flap 132 disposed at a second end 134 of the second section decorative panel. The blank 110 still further includes a third section 136 connected to second section 124, the third section having a third section decorative panel 138, a third section top flap 140 disposed at a first end 142 of the third section decorative panel and a third section bottom flap 144 disposed at a second end 146 of the third section decorative panel. The blank 110 still further includes a fourth section 148 connected to third section 136, the fourth section having a fourth section decorative panel 150 and a fourth section top flap 152 disposed at a first end 154 of the fourth section decorative panel and a fourth section bottom flap 156 disposed at a second end 158 of the fourth section decorative panel. Finally, the blank 110 includes a tab 160 connected to a third end 162 of either the fourth section decorative panel 150 or the first section decorative panel 114. Tab 160 is utilized to secure the fourth section decorative panel 150 to the first section decorative panel 114 in constructing a dispenser that can be made from the blank 110. To form the dispenser, the blank is folded along a plurality of fold lines 163 separating the various panels, flaps, and tab portions of the blank.

The first, second, third and fourth section decorative panels form a sidewall 164 of the dispenser having a continuous decorative surface 166 between the arrowheads on the longitudinal center line. The continuous decorative surface can be on the interior or the exterior of the dispenser, but is typically on the exterior of the dispenser. Continuous decorative surface 166 is referred to as a continuous decorative surface in that it can receive vector or graphic art in, for example, printed form, to maximize a visual effect to a consumer. Advantageously by spanning across several decorative panels, the registration problems that typically occur as a result of having the closing flaps forming at least a portion of the dispenser's sidewall, as seen in the upright tissue carton of FIG. 3 are eliminated. The flaps on the sidewall can interrupt a continuous design that is placed onto the sidewall since the top and bottom flap must be folded perfectly to meet with each other and the remainder of the dispenser such that the registration of the design is not interrupted. In this type of upright dispenser, the flaps may not be perfectly folded and sealed such that the graphics on the flaps align with the graphics on the other decorative panels forming the sidewall. Moreover, when the flaps form a portion of the sidewall, discontinuous boundaries result at the flaps that impede the visual unity of any graphics design applied to the dispenser's sidewall.

The blank further includes a dispensing opening 168 and optionally includes a dispensing window 170. For loading on an automated carton line, the dispensing window should be pre-attached to the carton blank by attaching the dispensing window to either the inside or the outside of the top flap, preferably on the inside as shown. The dispensing window can be made from a suitable material such as a film, nonwoven, or paper material that can retain a partially dispensed sheet, such as a facial tissue, within the dispensing opening for pop-up dispensing. The dispensing window 170 has a dispensing orifice 171 that can be a slit; a curvilinear line; a geometric shape such as an oval, a circle, or a triangle; or X-shaped, +-shaped or H-shaped orifice. Alternatively, the dispensing window can be eliminated and fingers or tabs projecting into the dispensing opening 168 can be used to retain a partially dispensed sheet.

The dispensing opening 168 can be any size or shape such as square, circular, or oval. The dispensing opening can be located such that it resides entirely in one of the top flaps or the dispensing opening can be located such that a portion resides in one of the top flaps and another portion resides in one of the decorative panels as shown. By having the dispensing opening span portions of the top flap and the decorative panel, the amount of board material utilized to form the carton can be minimized. This occurs since the overall size of the top flaps can be decreased because less material is needed to surround the dispensing opening. Additionally, by having the dispensing opening span portions of the top flap and the decorative panel, a unitary or one-piece dispensing window can be used that simplifies the overall construction of the carton and allows for maximum flexibility in choosing the shape of the dispensing orifice. By unitary it is meant that the dispensing window is a single continuous piece rather than formed from two or more pieces that meet or overlap. Because the window is unitary, any desired shape for the dispensing orifice can be cut into the window without concern of having separate pieces meet or join together precisely to form the dispensing orifice and/or dispensing window.

The blank further includes an optional removable surfboard 172 that can be attached to the top flap by a perforated or weakened line. The removable surfboard can be used to prevent foreign materials from entering the assembled dispenser and provides protection for the more fragile dispensing window during loading and shipping. The blank can also include an optional film wrapper 173 (FIG. 7) that can span any of the decorative panels (114, 126, 138, and 150) by attaching the opposing ends of the film wrapper to the top and bottom flaps of the chosen decorative panel. The film wrapper can be used to display printed information, such as a prominent trademark, that can identify the manufacturer at the point of purchase, which then later can be removed by the consumer so as not to detract from the continuous graphic design on the sidewall of the dispenser.

The carton blank 110 can be designed such that there are major flaps and minor flaps. The major flaps have a longer over all length than the minor flaps. In the illustrated embodiment, the major flaps are 128, 132, 152, and 156, while the minor flaps are 116, 120, 140, and 144. Alternatively, the carton can be designed such that all the flaps are approximately the same length. To minimize the carton material required, the major flaps are designed to have a length that is approximately ½ the distance between opposing decorative panels in the assembled dispenser. In this manner, the major flaps will just meet or slightly overlap when folded to form the top or bottom of the dispenser. While extra material can be used, such as a top or bottom flap that spans the entire end of the dispenser, more board is needed resulting in a more expensive carton and reduced nesting of adjacent blanks during the die cutting process that increases waste or scrap material when cutting the blanks.

FIG. 7 shows a perspective view of a dispenser 174 that can be formed from the blank 110 of FIG. 6. In one embodiment, the dispenser comprised an upright tissue carton and housed a plurality of facial tissue sheets. Shown are the first section decorative panel 114 and the second section decorative panel 126, the second section top flap 128, and the fourth section top flap 152. The top flaps form a dispenser top 176, while the bottom flaps form a dispenser bottom 177. In the completed dispenser 174, decorative panels 114 and 126 are folded so as to be in side fold continuity across an edge 178, and by this it is meant that there is a continuity of material, which is used to create or form the continuous decorative surface as described previously. The exterior of the dispenser, and in particular the continuous decorative surface, is particularly well suited for receiving commercially suitable decoration, such as image, print, indicia, graphics, Fresnel lens, lenticular lens, color, an embossed area, a debossed area, and/or coating(s). Advantageously, the sidewall 164 of the dispenser is not interrupted by the closing flaps as shown in the dispenser of FIG. 3. The sidewall 164 of the dispenser is in side fold continuity across three of the four edges 178 joining the four decorative panels forming the sidewall, with the exception of the interruption where the fourth decorative panel 150 is joined to the first decorative panel 114 at edge 180.

The dispenser top and bottom can be formed by folding either the major flaps over the minor flaps as shown, or by reversing the folding sequence such that the minor flaps are folded over the major flaps. Thus, for the illustrated folding sequence, the major flaps (128, 132, 152, and 156) are in top and bottom fold continuity across the first and second ends (130 and 134) of the second decorative panel 126 and across the first and second ends (154 and 158) of the fourth decorative panel 150. The design is interrupted at the first and second ends (118 and 122) of the first decorative panel 114 and at the first and second ends (142 and 146) of the third decorative panel 138. The misalignment in the flaps relative to the edges of the carton is exaggerated for the purposes of illustration in FIG. 7 and they would be much less noticeable in the actual folded cartons. Additionally, the flaps can be cut such that there is less taper along the length of the flap so as to more align the edges of the flaps with the edges of the top and bottom of the dispenser. However, by folding the major flaps first and then the minor flaps, it is possible to achieve more top and bottom fold continuity around the top and bottom perimeters of the dispenser.

EXAMPLES

Referring now to Table 1, the Fill Ratio for various upright facial tissue dispensers is shown for several commercially available products and for the invention. The Fill Ratio is calculated by first calculating the clip's unfolded volume (height×width×length). For this calculation, the folded clip is gently removed from the dispenser, carefully unfolded, and then laid flat on a horizontal surface by smoothing out the top of the clip. The average height, average width, and average length of the flat clip is determined by taking repeated measurements of each dimension until a reliable average for each can be determined. Next, the interior volume of the upright dispenser can be calculated by measuring the interior width, depth, and height of the dispenser (width×depth×height). If the dispenser is irregularly shaped, the maximum volume of water or sand that can be contained by the dispenser can be used to determine the interior volume. To determine the Fill Ratio as a percentage, the clip's unfolded volume is divided by the dispenser's interior volume and multiplied by 100.

The Fill Ratio compares the volume occupied by the uncompressed flat clip to the available interior volume of the upright dispenser. If the entire interior volume of the upright dispenser is filled by the volume of the uncompressed flat clip, the Fill Ratio would be 100 percent. As more of the carton's interior volume becomes unoccupied by the clip, the Fill Ratio decreases. It is possible for the Fill Ratio to be larger than 100 percent if the clip is significantly compressed while contained within the dispenser. Depending on the level of compression, dispensing related problems could be encountered for fill ratios larger than 100 percent.

Comparative 1 was a KLEENEX branded upright containing 85 two-ply facial tissue sheets having a calculated Fill Ratio of 62.8 percent. Comparative 2 was a KLEENEX branded upright containing 65 three-ply lotion treated facial tissue sheets having a calculated Fill Ratio of 71.1 percent. Comparative 3 was a PUFFS branded upright containing 76 two-ply facial tissue sheets having a calculated Fill Ratio of 67.8 percent. Comparative 4 was a PUFFS branded upright containing 64 three-ply lotion treated facial tissue sheets having a calculated Fill Ratio of 70.5 percent. Comparative 5 was a SCOTTIES branded upright containing 65 three-ply lotion treated facial tissue sheets having a calculated Fill Ratio of 66.5 percent.

Example 1 was a J-Shaped interfolded facial tissue clip folded about a transverse fold axis having an offset distance X of 10 mm from the transverse central axis and containing 130 two-ply facial tissue sheets. The J-shaped clip was placed into an upright dispenser as shown in FIG. 4 having an angle $\alpha$ of approximately 3 degrees. The resulting product had a Fill Ratio of 96.2 percent while still dispensing the tissue in an acceptable manner similar to the Comparative products.

Example 2 was a J-Shaped interfolded facial tissue clip folded about a transverse fold axis having an offset distance X of 10 mm from the transverse central axis and containing 85 three-ply facial tissue sheets. The J-shaped clip was placed into an upright dispenser as shown in FIG. 4 having an angle $\alpha$ of approximately 3 degrees. The resulting product had a Fill Ratio of 92.7 percent while still dispensing the tissue in an acceptable manner similar to the Comparative products.

TABLE 1

| | Sheets Per Clip | Clip Width (in) | Clip Length (in) | Clip Height (in) | Clip Volume ($in^3$) |
|---|---|---|---|---|---|
| Comparative 1 | 85 | 4.38 | 8.60 | 1.60 | 60.27 |
| Comparative 2 | 65 | 4.38 | 8.60 | 1.81 | 68.18 |
| Comparative 3 | 76 | 4.38 | 8.60 | 1.76 | 66.30 |
| Comparative 4 | 64 | 4.38 | 8.60 | 1.83 | 68.93 |
| Comparative 5 | 65 | 4.38 | 9.00 | 1.74 | 68.59 |
| Example 1 | 130 | 4.38 | 8.60 | 2.45 | 92.29 |
| Example 2 | 85 | 4.38 | 8.60 | 2.36 | 88.90 |

| | Carton Width (in) | Carton Depth (in) | Carton Height (in) | Carton Volume ($in^3$) | Fill Ratio (percent) |
|---|---|---|---|---|---|
| Comparative 1 | 4.38 | 4.38 | 5.00 | 95.92 | 62.8 |
| Comparative 2 | 4.38 | 4.38 | 5.00 | 95.92 | 71.1 |
| Comparative 3 | 4.38 | 4.25 | 5.25 | 97.73 | 67.8 |
| Comparative 4 | 4.38 | 4.25 | 5.25 | 97.73 | 70.5 |
| Comparative 5 | 4.38 | 4.38 | 5.38 | 103.21 | 66.5 |
| Example 1 | 4.38 | 4.38 | 5.00 | 95.92 | 96.2 |
| Example 2 | 4.38 | 4.38 | 5.00 | 95.92 | 92.7 |

Examples 1 and 2 were determined to be approximately the maximum number of two-ply and three-ply facial tissue sheets that could be placed into a standard upright tissue carton without increasing dispensing related problems. If desired, lower sheet count clips can be placed into the upright dispenser to obtain Fill Ratios between the Comparative products and the Examples. For two-ply facial tissue, clips having between about 100 sheets to about 130 sheets dispense well, and for three-ply facial tissue, clips having between about 70 sheets to about 85 sheets work well. Of course, changes in the sheet's size or thickness will affect the number of sheets that can be placed into the dispenser.

In various embodiments of the invention, the Fill Ratio of the upright dispenser can be between about 75 percent to about 100 percent, or between about 80 percent to about 98 percent, or between about 85 percent to about 98 percent, or between about 90 percent to about 97 percent. As seen, the invention provides for a significant improvement in the Fill Ratio versus the Comparative products.

While the invention has been so far discussed in relation to upright facial tissue dispensers, the invention is not limited only to this embodiment. Other sheet materials can be placed into the dispenser or the dispenser can be configured by suitable means to dispense wet sheet materials. Additionally, the invention is not limited to upright or boutique style dispensers. Dispensers with varying geometric sidewall shapes, such as oval, circular, triangular, or hexagonal can be used. Furthermore, the dispensing opening can be positioned anywhere on the dispenser and is not limited to being positioned solely on the dispenser's top.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A folded clip of sheet material disposed in an upright dispenser having a Fill Ratio between about 75 percent to about 100 percent and wherein the folded clip is J-shaped.

2. The product of claim 1 wherein the Fill Ratio is between about 80 percent to about 98 percent.

3. The product of claim 1 wherein the Fill Ratio is between about 85 percent to about 98 percent.

4. The product of claim 1 wherein the Fill Ratio is between about 90 percent to about 97 percent.

* * * * *